United States Patent [19]

Fukui et al.

[11] 4,437,913

[45] Mar. 20, 1984

[54] COBALT BASE ALLOY

[75] Inventors: Yutaka Fukui; Tetsuo Kashimura, both of Hitachi, Japan

[73] Assignee: Hitachi, Ltd., Tokyo, Japan

[21] Appl. No.: 286,514

[22] Filed: Jul. 24, 1981

Related U.S. Application Data

[63] Continuation-in-part of Ser. No. 98,665, Nov. 29, 1979, abandoned.

[30] Foreign Application Priority Data

Dec. 4, 1978 [JP] Japan ..... 53-149135

[51] Int. Cl.[3] ..... C22C 19/07

[52] U.S. Cl. ..... 148/408; 148/158

[58] Field of Search ..... 75/171, 170; 148/32, 148/32.5, 158

[56] References Cited

U.S. PATENT DOCUMENTS 3,582,320 6/1971 Herchenroeder ..... 75/171

*Primary Examiner*—R. Dean

*Attorney, Agent, or Firm*—Antonelli, Terry & Wands

[57] ABSTRACT

A cobalt base alloy having a superior high-temperature strength and high-temperature ductility, containing, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% zirconium, less than 10% iron, less than 1% tantalum, less than 1% hafnium and remainder cobalt. At least one of 0.01 to 1 wt% titanium and 0.01 to 1 wt% (combined amount) rare earth elements is added to the alloy. The alloy is used as a casting and contains eutectic carbides and secondary carbides precipitated substantially uniformly in the grains. If the secondary carbides are formed by an age-treatment conducted at a higher temperature than that at which the alloy is actually used, the high-temperature strength and the high-temperature ductility of the alloy are remarkably improved. The cobalt base alloy is formed into gas turbine nozzles by a precision casting.

10 Claims, 6 Drawing Figures x 400 x 400

COBALT BASE ALLOY

CROSS REFERENCE TO THE RELATED APPLICATION

This is a continuation-in-part of U.S. Ser. No. 98,665 filed on Nov. 29, 1979, abandoned.

BACKGROUND OF THE INVENTION

The present invention relates to a cobalt base alloy (referred to as Co base alloy hereinafter) and, more particularly, to a Co base cast alloy having a superior high-temperature strength and a high-temperature ductility.

Co base alloys have been used as the materials for mechanical parts which are subjected to drastic and repeated heating and cooling. A typical example of such mechanical parts is the first stage nozzle of a gas turbine. The first stage nozzle of the gas turbine is usually designed to withstand a long use of 20 to 30 thousand hours or longer at a high temperature of 800° to 1000° C. The condition of use of the first stage nozzle of gas turbine is very severe.

A Co base superheat resisting cast alloy is produced by a precision casting. The development of Co base heat-resisting superalloy has been made hitherto aiming mainly at achieving a superior high-temperature strength, particularly a high creep rupture strength. As a result, the conventional Co base heat-resisting superalloys disadvantageously exhibit an inferior high-temperature ductility, although the high-temperature strength have been improved considerably.

On the other hand, various investigations and studies show that the cracking of the first stage nozzle at gas turbine which is often observed during use of the gas turbine is attributable to a repetition of thermal stress, i.e. to a thermal fatigue, rather than to a lack of the high-temperature strength. The thermal fatigue is affected by high-temperature ductility, as well as the high-temperature strength, of the material. The conventional Co base cast alloys for nozzles which have been developed mainly aiming at a high-temperature strength possess sufficiently high creep rupture strengths. In fact, these conventional Co base cast alloy exhibit ductility against creep rupture of a level exceeding that required practically up to a temperature below 900° C. As the temperature is increased up to, for example, 982° C., the ductility is drastically lowered. For example, the elongation ratio in a long-term creep rupture test for 1,000 hours or longer is as small as several percents. In consequence, cracks are often caused in the nozzle of the gas turbine when the nozzle is used at a temperature exceeding 900° C. For this reason, it is desirable that the nozzle material is superior in both of the high-temperature strength and high-temperature ductility and that the high-temperature ductility is not lowered even at temperatures above 900° C. A superior high-temperature ductility offers another advantage of easy repair of the nozzle by welding, even if a crack is generated in the nozzle.

The conventional Co base alloy exhibits a high-temperature ductility which is high at the temperature range below 900° C. but decreases drastically as the temperature is increased beyond 900° C. This is attributable to the following reason.

Namely, conventional Co base alloy is made to have a large chromium (Cr) content in order to compensate for the low anti-oxidation characteristic of the Co.

Therefore, film-like non-metallic inclusions, which are possibly oxides, are formed in the grain boundaries during the casting to hinder the free deformation of the grains. The reduction of ductility can be attributed to this difficulty in deformation of the grains.

More specifically, at the temperature below 900° C., the ductility of the matrix is large enough to overcome the influence of the non-metallic inclusions in the grain boundaries, because the amount of precipitation is not so large at such a comparatively low temperature. The alloy, therefore, exhibits a sufficiently high ductility at such a low temperature. However, at the high-temperature such as 982° C., precipitation of carbides in the matrix is promoted to make the deformation of the same difficult. In consequence, the influence of the non-metallic inclusions in the grain boundaries become more strong. Namely, at the temperature range above 982° C., the deformation at the grain boundaries is hindered by the non-metallic inclusions so that the ductility of the alloy is considerably lowered. The non-metallic inclusions are considered to be oxides, although the detail of structure thereof has not been clarified yet. Also, a large Cr content promotes the precipitation of nitrides at the high-temperature exceeding 982° C., which also causes the reduction of ductility of the alloy.

On the other hand, in the Co base cast alloy having a high Cr concentration, a grain boundary oxidation is caused in the atmosphere to lower the ductility of the alloy. Generally, a high-strength Co base cast alloy contains solid solution hardeners such as tungsten (W), molybdenum (Mo) or the like and is reinforced by a formation of carbides. The carbides are formed in the network-like pattern in the grain boundaries.

The carbides are liable to be selectively oxidized at high-temperature, while the diffusion of oxygen is made rapidly in the grain boundaries. As a result, the oxidation of the network carbides in the grain boundaries is accelerated. This acceleration of the oxidation in the grain boundaries in turn causes a concentration of stress, resulting in a reduction of the strength, as well as ductility.

In order to increase the high-temperature strength of the Co base cast alloy, it has been proposed to add a large amount of strong carbide formers such as titanium (Ti), zirconium (Zr), niobium (Nb), tantalum (Ta) and the like. This type of Co base cast alloy is disclosed, for example, in the specification of U.S. Pat. No. 3,432,294.

Also, specifications of U.S. Pat. Nos. 3,582,320 and 4,080,202 discloses Co base cast alloy in which traces of these elements are contained.

These Co base cast alloys, however, are still insufficient to provide the required high-temperature strength and high-temperature ductility.

(1) As disclosed in the specification of U.S. Pat. No. 4,080,202, the present inventors discovered that a heat treated cobalt base cast alloy containing Ti and Nb which are strong MC-type carbide formers exhibits high strength and high ductility. However, it was difficult to sufficiently smooth the casting surface of this alloy in as-cast state, and it was discovered that when a very small amount of zirconium is added to this alloy the casting surface becomes good.

Also it was found that the casting surface degrading effect of titanium is larger than that of niobium.

Recently, there is an increasing demand for development of gas turbines having high efficiency. The high efficiency of the gas turbine is achievable by an extremely high gas temperature which well reaches 1,300 to 1,600° C. at the turbine inlet. This in turn gives rise to the demand for a higher strength against the thermal stress of the nozzle material. For instance, the nozzle material is required to have a high rupture strength of 4.3 $Kg/mm^2$ or higher in 1,000 hours creep rupture strength test at 982° C., as well as a high reduction of area of at least 20% in 100 hours rupture test at the same temperature.

SUMMARY OF THE INVENTION (1) Object of the Invention

It is, therefore, an object of the invention to provide a Co base alloy having superior high-temperature strength and high-temperature ductility particularly a Co base alloy which exhibit superior high temperature strength and high temperature ductility at high-temperature range above 900° C.

(2) Statement of the Invention

To this end, according to the invention, there is provided a cobalt base alloy containing, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, less than 10% iron, less than 1% tantalum, less than 1% hafnium and remainder substantially cobalt. According to another aspect of the invention, there is provided a cobalt base alloy containing, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, less than 1% tantalum less than 1% hafnium, less than 10% iron and remainder substantially cobalt.

According to still another object of the invention, there is provided a cobalt base alloy containing, by weight, 0.15 to 2% carbon, less than 2% silicon, less than 2% manganese, 5 to 15% nickel, 18 to 35% chromium, 3 to 15% tungsten, 0.01 to 1% titanium, 0.01 to 1% niobium, 0.003 to 0.1% boron, 0.01 to 1% zirconium, less than 10% iron, less than 1% tantalum, less than 1% hafnium, 0.01 to 1% (combined amount) rare earth elements, and remainder cobalt and inevitable impurities.

According to a further aspect of the invention, it is possible to obtain a cobalt base alloy having an improved high-temperature strength by means of selecting the titanium (Ti), niobium (Nb), zirconium (Zr) and carbon (C) contents such that the value calculated from the following equation falls within the range of between 0.01 and 0.17, preferably between 0.03 and 0.08.

$$\frac{\text{Ti (atomic \%)} + \text{Nb (atomic \%)} + \text{Zr (atomic \%)}}{\text{C (atomic \%)}} \times \text{Zr (wt \%)}$$

The Co base alloy of the invention possesses not only the superior high-temperature strength but also a high resistance against fatigue caused by thermal stress caused by repeated change of temperature. Particularly, the Co base alloy of the invention exhibits a superior high-temperature ductility even at a high temperature of 982° C.

DESCRIPTION OF THE PREFERRED EMBODIMENTS

Figure 1:
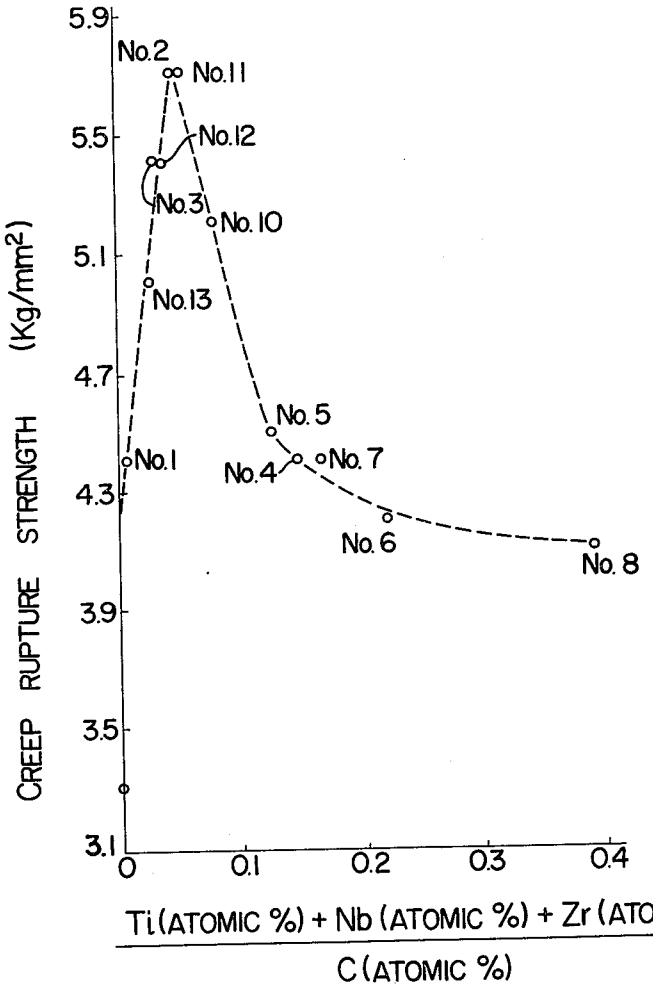
FIG. 1 is a chart showing the relation between the creep rupture strength and Ti, Nb, Zr and C contents.

Hereinafter, a description will be made as to the reasons for limitation of constituents of the alloy composition in accordance with the invention.

C: 0.15 to 2 wt%

Carbon (C) is an essential element for improving the high-temperature strength and high-temperature ductility of the alloy. For achieving the desired improvement in the strength and ductility, it is necessary that the carbon content is not smaller than 0.15%. The desired strength will not be obtained also when the carbon content exceeds 2 wt%. Also, carbon content in excess of 2% will cause a cohesion of carbides when heated at a high temperature for a long time, resulting in a deterioration of the ductility. Thus, the carbon content is selected preferably to range between 0.15 and 1.5% and, more preferably, between 0.25 and 0.8%, from the view point of combination with other constituents such as Ti, Nb and Zr which will be described later.

Si: less than 2 wt %

Silicon is generally added as a deoxidizer and is effective also in improving the anti-oxidation property. For obtaining a sufficient deoxidizing effect, the silicon content is preferably higher than 0.3%. A silicon content exceeding 2%, however, is not preferred because such a high silicon content is liable to leave inclusions. A good effect is obtained particularly when the silicon content falls within the range between 0.3 and 1%.

W: 3 to 15 wt%

More than 3% of tungsten is added to improve the high-temperature strength of the alloy. The tungsten content, however, is limited to be not greater than 15%, because such a high tungsten content will deteriorate the anti-oxidation property of the alloy. A good effect is obtained particularly when the tungsten content falls within the range between 6 and 8%.

B: 0.003 to 0.1 wt%

Boron is added to improve the high-temperature strength and also the high-temperature ductility. An appreciable effect would not be obtained if the boron content is less than 0.003%. Also, a boron content in excess of 0.1% will deteriorate the weldability of the alloy. For this reason, the boron content is limited to fall within the range between 0.003 and 0.1%, preferably 0.005 to 0.015%.

Zr: 0.01 to 1 wt%

Ti: 0.01 to 1 wt%

Nb: 0.01 to 1 wt%

A remarkable effect can be obtained by adding, in combination, niobium (Nb) and zirconium (Zr), preferably titanium (Ti), Nb and Zr. The effect of these elements is remarkable particularly in combination with the carbon, tungsten, boron, chromium and nickel contents as specified above and hereinunder.

Generally, zirconium, titanium, and niobium are used as strong carbide-precipitation strengthening elements in heat resisting alloys. The Co base alloy, however, is used at such a high temperature that the strengthening by precipitation of carbide cannot be expected. The present inventors have found that a high strength and a high toughness are simultaneously achieved by the combined addition of niobium and zirconium, or titanium, niobium and zirconium. For achieving the desired improvement in the high-temperature strength and high-temperature ductility, the amount of each of these elements should be at least 0.01%. By addition of small amount of these elements, the eutectic carbides are divided and, at the same time, deoxidation and denitrification effects are performed, so that the creep rupture strength, as well as the elongation and reduction of area at the rupture, is considerably improved.

These strong carbide formers, however, inconveniently promotes the formation of inclusions and cohesion of carbides, and makes the alloy brittle, if the amount of any one of these elements exceeds 1%. Particularly, niobium seriously deteriorates the anti-oxidation property of alloy when the amount thereof exceeds 1%. For these reasons, the contents of these elements should be limited to be not greater than 1%. A combination of 0.05 to 0.5% titanium, 0.1 to 0.6% niobium and 0.05 to 0.25% zirconium is preferred. The best result is produced by a combination of 0.1 to 0.2% titanium, 0.2 to 0.3% niobium and 0.1 to 0.2% zirconium.

The addition of 0.01–1% Ti in the present invention has such an advantage for a cobalt base cast alloy that it makes possible to finely and uniformly disperse the eutectic carbides and the secondary carbides thereby increasing the high temperature strength and the toughness. On the contrary, the addition of excess amount of Ti is liable to roughen a casting surface of a casting thereby forming an irregularity. Accordingly, in case of a member such as a nozzle for gas turbine used in its as-cast state, if the irregularity is formed on the casting surface the high temperature properties, particularly high temperature fatigue resistance, is decreased thereby shortening a service life. To the contrary, in the present invention by adding the specified amounts of Nb and Zr and the specified amount of Ti in combination, it is possible to obtain a casting having a satisfactory casting surface.

Rare earth elements: 0.01 to 1 wt% (combined amount)

Rare earth elements has strong deoxidizing and desulfurization abilities, and also improve the high-temperature ductility particularly when used together with the aforementioned combination of zirconium, titanium and niobium. The effect, however, is not remarkable when the contents of rare earth elements is below 0.01%. Also, a rare earth element content in excess of 1% undesirably promotes the formation of inclusions and lowers the high-temperature ductility and, therefore, is not preferred. A good result is obtained when the content of rare earth elements falls within the range between 0.2 and 0.4%. Typical example of these rare earth elements are scandium, yttrium and lanthanoid among which the lanthanoid is most effective.

A typical example of the lanthanoid is mischmetal which is constituted mainly by cerium (Ce) and lanthanum (La). Commercially available mischmetal contains, by weight, 52% cerium, 24% lanthanum, 18% neodymium (Nd) and 5% praseodymium (Pr).

The addition of the rare earth elements is made aiming mainly at causing a deoxidizing effect. Therefore, the addition of the rare earth elements can be eliminated if the melting of the material is made under a vacuum which provides an equivalent deoxidizing effect. The melting under the vacuum, however, cannot provide the desulfurization effect. The addition of the rare earth elements, therefore, is still effective even in case of the vacuum melting.

Mn: less than 2 wt %

As is the case of silicon, manganese (Mn) is added as a deoxidizer. For obtaining a good effect, the manganese content is preferably higher than 0.3%. However, a manganese content in excess of 2% deteriorates the anti-oxidation property. The manganese content, therefore, is preferably between 0.3 and 1%.

Ni: 5 to 15 wt%

For improving the high-temperature strength of the alloy, the alloy should contain more than 5% nickel. The larger nickel content, however, does not provide proportional increase in the high-temperature strength. The nickel content, therefore, is limited to fall within the range between 5 and 15%, preferably between 9.5 and 11.5%.

Cr: 18 to 35 wt%

The chromium content should be selected in relation to the titanium content to avoid the cold shot and internal oxidation of the carbides. More than 18% of chromium is required for improving the anti-oxidation property of the alloy. However, a chromium content in excess of 35% will cause a reduction in the high-temperature ductility due to the generation of cold shot and internal oxidation of the carbides during the use. The chromium content in excess of 35% also makes the alloy brittle during a long use at a high-temperature. Within the above specified range of the chromium content, a range between 28 and 31% is preferred.

Fe: less than 10 wt%

In adding the elements such as carbon, manganese, tungsten, niobium, titanium, zirconium, tantalum, hafnium, boron and so forth, iron (Fe) is also added as a master alloy for effectively improving the yield of addition of these elements. The high-temperature strength, however, will be lowered by an iron content exceeding 10%. For maintaining a good high-temperature strength, the iron content is preferably not greater than 4%.

Ta and Hf: less than 1 wt%

Tantalum and hafnium are strong carbide formers. Therefore, an excessive addition of these elements inconveniently permit the formation of too large eutectic carbides, resulting in a deterioration of both of the high-temperature strength and the high-temperature ductility. It is possible to obtain a high strength by obtaining the eutectic carbides in the form of fine grains rather than in the form of connected network. The content of these elements, therefore, is selected to be not greater than 1%, preferably between 0.1 and 0.6%.

The present invention ensures a superior high-temperature strength and a high toughness of the Co base cast alloy. Usually, the Co base cast alloy contains a high carbon content to permit the formation of eutectic carbides which contribute to the high strength. Therefore, the strength of the alloy is largely affected by the state of the eutectic carbides. In the Co base alloy of the invention, the eutectic carbides residing along the grain boundaries are divided into sections by the addition of the titanium, niobium and zirconium, so that a superior high-temperature strength and high-temperature ductility are ensured. The Co base alloy of the invention, therefore, is advantageously used particularly as a cast.

The addition of titanium to the alloy deteriorates the smoothness of the surface of the cast. This problem, however, is fairly overcome by the addition of the zirconium.

The Co base cast alloy of the invention includes eutectic carbides and also secondary carbides which are uniformly precipitated in the grains. Preferably, the secondary carbides are precipitated at a temperature higher than that at which the product is actually used, i.e. by an age-treatment. By so doing, the undesirable precipitation of the secondary carbides during the actual use is effectively prevented, so that the deterioration of the strength and the toughness is fairly avoided. The age-treatment is preferably performed by a solution heat-treatment.

If the alloy is used without a previous age-treatment, precipitation of carbides around the grain boundaries is more likely to take place under the application of large stress at a high temperature, which in turn lowers the strength and ductility.

However, if the cast alloy of the invention is subjected, before the actual use, to an age-treatment while no stress is taking place in the alloy, the precipitation of the secondary carbides are dispersed uniformly throughout the grains.

Since the Co base cast alloy of the invention provides a smooth casting surface, it can suitably be used as the material for precision casting ensuring a smooth and fine casting surface of the cast. This feature is quite conveniently utilized in the casting of thin-walled articles such as nozzles of gas turbines.

EXAMPLES

The attached table shows the chemical compositions (wt%) of specimen. From these alloys, cast of 100 mm×200 mm×15 mm were formed by a high-frequency melting, using molds fabricated by a lost wax process. The conventional alloy used by way of reference is an alloy which is produced by melting in the air the mixture of carbon, nickel, chromium, tungsten, iron, boron and cobalt and then adding silicon and manganese into molten mixture.

The alloys of the specimen Nos. 1 to 15 were prepared by at first combining carbon, nickel, chromium, tungsten, iron, boron and cobalt and melting them in the air, adding silicon and manganese, and finally adding niobium, titanium, zirconium, tantalum and hafnium. Among these specimens, and specimen Nos. 5 and 7 were produced by adding 0.3% (combined amount) of mischmetal, subsequently to the addition of the silicon and manganese. The lanthanum and cerium contents of these alloys were analyzed to be about 25 ppm and about 100 ppm, respectively.

Specimen Nos. 1 to 8, 10 to 13 and 15 are the alloys of the invention, while specimen Nos. 9 and 14 are reference alloys. Each specimen was heated for 4 hours at 1150° C. and was then cooled down to 982° C. Then, after holding at that temperature for 4 hours, the specimen was cooled down to the room temperature. Then, a creep rupture test piece of 30 mm long and 6 mm dia. (at parallel portion) was cut out from each specimen and subjected to a test.

The table show the 1000-hour creep rupture strength at 982° C., as well as reduction of area at 100-hour creep rupture, as observed for each test piece. It will be seen that the alloys of the invention provide much superior strength and reduction of area to those of the conventional reference alloys.

FIG. 1 is a chart showing the relationship between the 1000-hour creep rupture strength at 982° C. as shown in Table and the value calculated from an equation [Ti(atomic%)+Nb(atomic %)+Zr(atomic %)]/C(atomic %)×Zr (wt%) for each of the alloys shown in Table. It will be clear from this chart that a superior high-temperature strength exceeding 4.3 Kg/mm² is obtained when the value determined by the above equation falls within the range between 0.01 and 0.12.

TABLE

| No. | C | Si | Mn | Cr | Ni | W | Nb | Ti |
|---|---|---|---|---|---|---|---|---|
| 1 | 0.28 | 0.57 | 0.59 | 30.31 | 10.46 | 7.33 | 0.42 | 0.01 |
| 2 | 0.29 | (0.6) | (0.6) | (29.5) | (10.5) | (7.0) | 0.24 | 0.15 |
| 3 | 0.30 | " | " | " | " | " | 0.24 | 0.10 |
| 4 | 0.28 | " | " | " | " | " | 0.36 | 0.25 |
| 5 | 0.30 | " | " | " | " | " | 0.39 | 0.15 |
| 6 | 0.31 | 0.74 | 0.38 | 30.08 | 10.76 | 7.09 | 0.58 | 0.26 |
| 7 | 0.30 | (0.6) | (0.6) | (29.5) | (10.5) | (7.0) | 0.25 | 0.25 |
| 8 | 0.28 | " | " | " | " | " | 0.69 | 0.35 |
| 9 | 0.05 | 0.47 | 0.70 | 29.27 | 10.48 | 7.18 | 0.20 | 0.16 |
| 10 | 0.22 | 0.64 | 0.61 | 28.92 | 10.44 | 7.49 | 0.24 | 0.11 |
| 11 | 0.36 | (0.6) | (0.6) | (29.5) | (10.5) | (7.0) | 0.24 | 0.15 |
| 12 | 0.58 | " | " | " | " | " | 0.24 | 0.13 |
| 13 | 0.94 | " | " | " | " | " | 0.24 | 0.15 |
| 14 | 2.80 | " | " | " | " | " | 0.24 | 0.15 |
| 15 | 0.43 | " | " | " | " | " | " | 0.14 |
| conventional alloy | 0.28 | 0.60 | 0.49 | 30.75 | 11.00 | 7.02 | — | — |

| No. | Zr | Fe | B | Co | $\left(\frac{Ti + Nb + Zr}{C} \times Zr\right)$ | Strength (Kg/mm²) | reduction of area (%) |
|---|---|---|---|---|---|---|---|
| 1 | 0.02 | 8.01 | 0.0178 | balance | 0.004 | 4.4 | 46 |
| 2 | 0.15 | (4.0) | 0.0165 | " | 0.044 | 5.7 | 61 |
| 3 | 0.16 | " | 0.0155 | " | 0.044 | 5.4 | 65 |
| 4 | 0.28 | " | 0.0173 | " | 0.146 | 4.4 | 49 |
| 5 | 0.31 | " | 0.0167 | " | 0.123 | 4.5 | 54 |
| 6 | 0.36 | 8.48 | 0.0148 | " | 0.218 | 4.2 | 40 |
| 7 | 0.35 | (4.0) | 0.0174 | " | 0.165 | 4.4 | 34 |
| 8 | 0.46 | " | 0.0152 | " | 0.390 | 4.1 | 48 |
| 9 | 0.18 | 3.54 | (0.01) | " | 0.322 | 3.1 | 44 |
| 10 | 0.20 | 3.32 | " | " | 0.077 | 5.3 | 66 |
| 11 | 0.19 | (3.0) | " | " | 0.044 | 5.7 | 66 |

TABLE-continued

| | | | | | | | |
|---|---|---|---|---|---|---|---|
| 12 | 0.20 | " | " | " | 0.031 | 5.4 | 84 |
| 13 | 0.23 | " | " | " | 0.024 | 5.0 | 54 |
| 14 | 0.03 | " | " | " | 0.001 | 3.7 | 24 |
| 15 | 0.21 | " | " | " | 0.046 | 5.7 | 75 |
| | | | | Ta 0.20 Hf 0.25 | | | |
| conventional alloy | — | 1.78 | 0.0141 | " | 0 | 3.2 | 19 |

Note:
Values in parentheses show aimed amounts.

Particularly, the highest high-temperature strength of above 5.3 Kg/mm$^2$, which is higher than the above-mentioned improved high-temperature strength by 1 Kg/mm$^2$, is obtained when the value determined by above equation falls within the range between 0.03 and 0.08.

Figure 2:
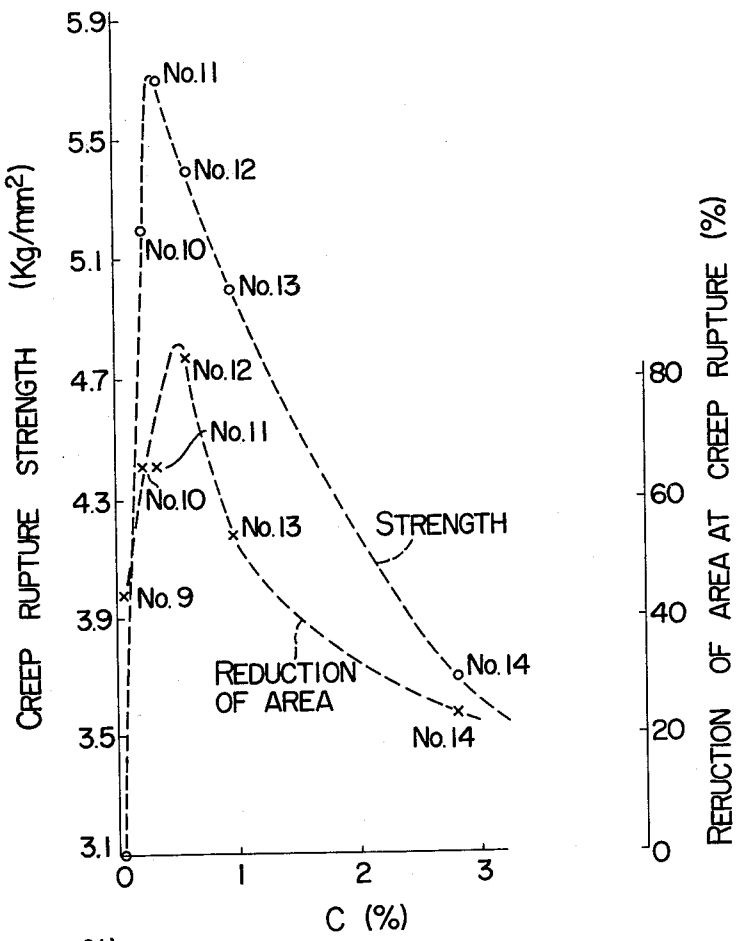
FIG. 2 is a chart showing the relation between the C content and the creep rupture strength.

FIG. 2 shows how the 1,000 hour creep rupture strength at 982° C. and the reduction of area at 100-hour rupture are affected by the carbon content, for each of specimen Nos. 9 to 14. It will be seen from this Figure that the strength and the reduction of area are drastically changed by a change in the carbon content, and that a high strength exceeding 4.3 Kg/mm$^2$ and a large reduction of area exceeding 40% are obtainable when the carbon content falls within the range between 0.15 and 1.5%. Particularly, the highest strength in excess of 5.1 Kg/mm$^2$ and a large reduction of area in excess of 60% are obtained when the carbon content falls within the range between 0.25 and 0.8%. It will be seen also that a further improvement in the strength and toughness is achievable by addition of tantalum and hafnium.

Figure 3:
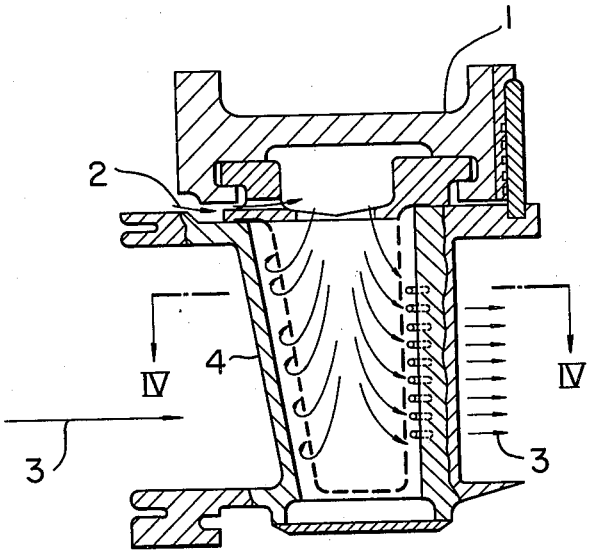
FIG. 3 is a sectional view of a nozzle segment for a gas turbine.
Figure 4:
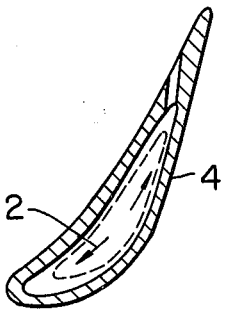
FIG. 4 is a sectional view taken along the line IV—IV of FIG. 3.

FIG. 3 shows in cross-section the construction of a nozzle segment for gas turbines. In this Figure, reference numeral 1 denotes a retainer ring, while a nozzle segment is designated at a reference numeral 4. Reference numerals 2 and 3 denote, respectively, the flow of cooling air and the flow of combustion gas of a high temperature. The nozzle of the gas turbine is constituted by a plurality of illustrated nozzle segments which are assembled in a ring-like form. FIG. 4 is a sectional view taken along the line IV—IV in FIG. 3. The nozzle segments may be formed independently, or 3 or 5 segments are formed integrally.

A piece of nozzle segment was produced with the alloy of the specimen No. 11 by means of a mold fabricated by a lost wax process. The melting and casting were made in the atmosphere. The cast metal was heated up to 1150° C. and maintained at that temperature for four hours. The cast metal was then cooled in a furnace down to 982° C. and held at this temperature for four hours. Then, the cast metal was cooled in the furnace down to 537° C. and finally air-cooled down to the room temperature.

The nozzle segment thus produced from a Co base cast alloy of the invention was subjected to a thermal cycle test, corrosion test and creep rupture test simulating the actual condition of use of the gas turbine. The corrosion test was conducted by applying sodium sulfate which simulates the condition of corrosion by the combustion gas produced as a result of combustion of kerosene. The nozzle segment produced from the Co base cast alloy of the invention exhibited a superior high-temperature strength and high-temperature ductility which are well comparable with those of the material of specimen No. 11 in Table. Also, the result of the thermal cycle test showed that the alloy of the invention exhibits an anti-fatigue strength which is superior to that of the cnventional alloy. Further, the result of the corrosion test showed that alloy of the invention has a higher corrosion resistance than the conventional alloys. Thus, it was confirmed that the alloy of the invention ensures a longer life of the nozzle of the gas turbine.

Figure 5:
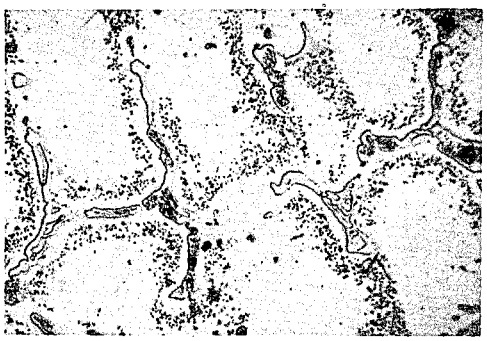
FIG. 5 is a microstructure of a nozzle segment (magnification: 400)

FIG. 5 shows a microstructure of this nozzle segment (magnification: 400). The alloy material of this segment contains eutectic carbides and secondary carbides dispersed in the vicinity of the grain boundaries.

Figure 6:
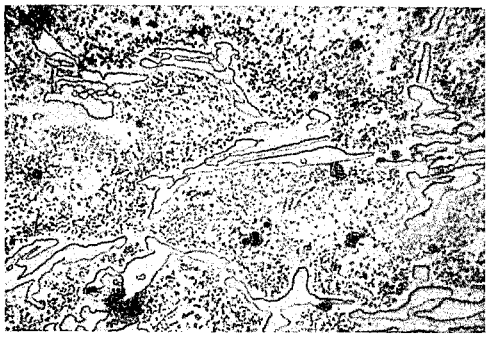
FIG. 6 is a microstructure of an alloy of the invention (magnification: 400).

The aforementioned alloy of the specimen No. 13 contains, as will be seen from a microstructure photograph (magnification: 400) shown in FIG. 6, eutectic carbides and secondary carbides which are precipitated substantially uniformly in the grains.

As has been described, according to the invention, there is provided a Co base alloy a super or high-temperature strength and high toughness. It is quite advantageous that the gas turbine nozzle produced from this alloy withstands a longer use than those produced from conventional alloys.

What is claimed is:

1. A cobalt base cast alloy consisting essentially of, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, less than 10% iron, less than 1% tantalum, less than 1% hafnium and the remainder substantially cobalt, wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17$$

and wherein there exist eutectic carbides and secondary carbides precipitated by an age-treatment in uniformly dispersed form in the vicinity of grain boundaries whereby growth of the secondary carbides is suppressed; said alloy having a creep rupture strength of higher than 4.3 Kg/mm$^2$ in 1,000 hours creep rupture at 982° C. and a reduction of area of at least 34% in 100 hours creep rupture at 982° C.

2. A cobalt base cast alloy as claimed in claim 1, wherein the value determined by said equation is between 0.03 and 0.08.

3. A cobalt base cast alloy consisting essentially of by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, 0.01 to 1% (combined amount) rare earth elements, less than 10% iron, less than 1% tantalum, less than 1% hafnium and remainder substantially cobalt wherein there exist eutectic carbides and secondary carbides precipitated by an age-treatment in uniformly dispersed form in the vicinity of grain boundaries whereby growth of the secondary carbides is suppressed and wherein the carbon (C), niobium (Nb), titanium (Ti) and zirconium (Zr) contents are so selected so as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17;$$

said alloy having a creep rupture strength of higher than 4.3 Kg/mm$^2$ in 1,000 hours creep rupture at 982° C. and a reduction of area of at least 34% in 100 hours creep rupture at 982° C.

4. A cobalt base cast alloy as claimed in claim 3, wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17.$$

5. A cobalt base cast alloy as claimed in claim 1, wherein the value determined by said equation is between 0.03 and 0.08.

6. A cobalt base cast alloy in the form of a nozzle for a gas turbine, said gas turbine being produced by precision casting and made of a cobalt base alloy consisting essentially of, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, less than 1% tantalum, less than 1% hafnium, less than 10% iron and remainder substantially cobalt, wherein said cast alloy contains eutectic carbides and secondary carbides precipitated by an age-treatment and dispersed uniformly in the vicinity of the grain boundaries whereby growth of the secondary carbides is suppressed and wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17;$$

said alloy material having a creep rupture strength of higher than 4.3 Kg/mm$^2$ in 1,000 hours creep rupture at 982° C. and a reduction of area of at least 34% in 100 hours creep rupture at 982° C.

7. A cobalt base cast alloy in the form of a nozzle for a gas turbine, said gas turbine being produced by precision casting and made of a cobalt base alloy consisting essentially of, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, 0.01 to 1% (combined amount) rare earth elements, less than 10% iron, less than 1% tantalum, less than 1% hafnium and remainder substantially cobalt, wherein said cast alloy contains eutectic carbides and secondary carbides precipitated by an age-treatment and dispersed uniformly in the vicinity of the grain boundaries whereby growth of the secondary carbides is suppressed and wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17;$$

said alloy material having a creep rupture strength of higher than 4.3 Kg/mm$^2$ in 1,000 hours creep rupture at 982° C. and a reduction of area of at least 34% in 100 hours creep rupture at 982° C.

8. A cobalt base cast alloy consisting essentially of, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, less than 10% iron, less than 1% tantalum, less than 1% hafnium and the remainder substantially cobalt, wherein said cast alloy has been subjected to a solution heat treatment and then to an age-treatment conducted at a temperature higher than the temperature at which said alloy is actually used, and contains eutectic carbides and secondary carbides uniformly dispersed in the vicinity of the grain boundaries whereby growth of the secondary carbides is suppressed and wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17;$$

and alloy material having a creep rupture strength of higher than 4.3 Kg/mm$^2$ in 1,000 hours creep rupture at 982° C. and a reduction of area of at least 34% in 100 hours creep rupture at 982° C.

9. A cobalt base cast alloy consisting essentially of, by weight, 0.15 to 2% carbon, less than 2% silicon, less than 2% manganese, 5 to 15% nickel, 18 to 35% chromium, 3 to 15% tungsten, 0.003 to 0.1% boron, 0.01 to 1% niobium, 0.01 to 1% titanium, 0.01 to 1% zirconium, 0.01 to 1% (combined amount) rare earth elements, less than 10% iron, less than 1% tantalum, less than 1% hafnium and remainder substantially cobalt, wherein said alloy has been subjected to a solution heat treatment and then to an age-treatment conducted at a higher temperature than that at which said alloy is actually used, and contains eutectic carbides and secondary carbides uniformly dispersed in the vicinity of the grain boundaries whereby growth of the secondary carbides is suppressed and wherein the carbon (C), niobium (Nb), titanium (Ti) and zirconium (Zr) contents are so selected as to satisfy the following equation:

$$\frac{\text{Ti (atomic \%)} + \text{Nb (atomic \%)} + \text{Zr (atomic \%)}}{\text{C (atomic \%)}} \times \text{Zr (wt \%)} = 0.01 \text{ to } 0.17;$$

said alloy material having a creep rupture strength of higher than 4.3 Kg/mm$^2$ in 1,000 hours creep rupture at 982° C. and a reduction of area of at least 34% in 100 hours creep rupture at 982° C.

10. A cobalt base cast alloy as claimed in claim 8, wherein said cast alloy is formed into a gas turbine nozzle by a precision casting.

* * * * *